US010914298B2

(12) United States Patent
Chou

(10) Patent No.: US 10,914,298 B2
(45) Date of Patent: Feb. 9, 2021

(54) STRUCTURE OF FIXING BEARING OF AIR COMPRESSOR

(71) Applicant: UNIK WORLD INDUSTRIAL CO., LTD., Tainan (TW)

(72) Inventor: Wen-San Chou, Tainan (TW)

( * ) Notice: Subject to any disclaimer, the term of this patent is extended or adjusted under 35 U.S.C. 154(b) by 0 days.

(21) Appl. No.: 16/534,500

(22) Filed: Aug. 7, 2019

(65) Prior Publication Data

US 2020/0049138 A1 Feb. 13, 2020

(51) Int. Cl.

| | |
|---|---|
| ***F04B 39/00*** | (2006.01) |
| ***F04B 35/01*** | (2006.01) |
| ***F04B 39/14*** | (2006.01) |

(52) U.S. Cl.

CPC ..... *F04B 39/00* (2013.01); *F04B 35/01* (2013.01); *F04B 39/14* (2013.01)

(58) Field of Classification Search

CPC ..... F04B 35/01; F04B 39/14

See application file for complete search history.

(56) References Cited

U.S. PATENT DOCUMENTS

| | | | | |
|---|---|---|---|---|
| 6,280,163 | B1 * | 8/2001 | Chou | F04B 35/01 417/360 |
| 8,523,452 | B2 * | 9/2013 | Yamakawa | F16C 35/067 384/570 |
| 9,028,352 | B2 * | 5/2015 | Wilson | F16H 7/20 474/166 |
| 9,945,369 | B2 * | 4/2018 | Chou | F04B 39/0022 |
| 9,957,966 | B2 * | 5/2018 | Chou | F04D 29/522 |
| 9,964,104 | B2 * | 5/2018 | Chou | F04B 35/06 |
| 10,384,406 | B2 * | 8/2019 | Spindler | F04B 35/01 |
| 10,385,848 | B2 * | 8/2019 | Chou | F04B 39/121 |
| 2004/0105766 | A1 * | 6/2004 | Chou | F04B 35/00 417/415 |
| 2013/0078119 | A1 * | 3/2013 | Chou | F04B 35/04 417/374 |

* cited by examiner

*Primary Examiner* — Michael Leslie

(57) ABSTRACT

A structure of fixing a bearing of an air compressor, the air compressor contains: a base, a cylinder, and a transmission mechanism. The base includes multiple positioning orifices, and one of the multiple positioning orifices accommodates a bearing. The cylinder is integrally connected with the base and includes an air storage chamber. The transmission mechanism actuates a piston to move in the cylinder reciprocatingly, thus producing compressed air. The first ring of the bearing is non-circular, and a shape of the one positioning orifice of the base corresponds to the first ring so as to avoid an idle rotation of the bearing in the one positioning orifice of the base or a removal of the bearing from the second positioning orifice.

11 Claims, 14 Drawing Sheets

STRUCTURE OF FIXING BEARING OF AIR COMPRESSOR

FIELD OF THE INVENTION

The present invention relates to a structure of fixing a bearing of an air compressor which avoids an idle rotation of the bearing in the base or a removal of the bearing from the second positioning orifice.

BACKGROUND OF THE INVENTION

With reference to FIG. 14, a conventional air compressor 1 for a vehicle contains: a base 11, a cylinder 12 connected on the base 11, a motor fixed on the base, and a piston driven by the motor to move in the cylinder 12 reciprocatingly, thus drawing, compressing, pressurizing, and discharging air out of the cylinder.

The motor is driven by a gear mechanism and a crank mechanism so as to actuate the piston to move. The gear mechanism includes a pinion fitted on a central shaft of the motor and a driven gear meshing with the pinion, a counterweight block of the crank mechanism is connected on the driven gear, and a connection post is rotatably connected with the piston. The base 11 includes an orifice 110 configured to accommodate a bearing 111 which is circular, and the connection post is eccentric with a shaft. When the driven gear is actuated by the pinion to rotate, the piston moves in the cylinder 12 reciprocatingly.

However, the base 11 is made of plastic, so it is easy to be softened. The piston pulls the bearing 111 each other to cause deformation, and the piston offset greatly to damage the orifice 110, thus reducing a service life of the piston and the bearing 111.

The present invention has arisen to mitigate and/or obviate the afore-described disadvantages.

SUMMARY OF THE INVENTION

The primary aspect of the present invention is to provide a structure of fixing a bearing of an air compressor which avoids an idle rotation of the bearing in the base or a removal of the bearing from the second positioning orifice.

Another aspect of the present invention is to provide a structure of fixing a bearing of an air compressor in which the piston operates in the cylinder smoothly, thus prolonging a service life of the air compressor.

DETAILED DESCRIPTION OF THE PREFERRED EMBODIMENTS

Figure 1:
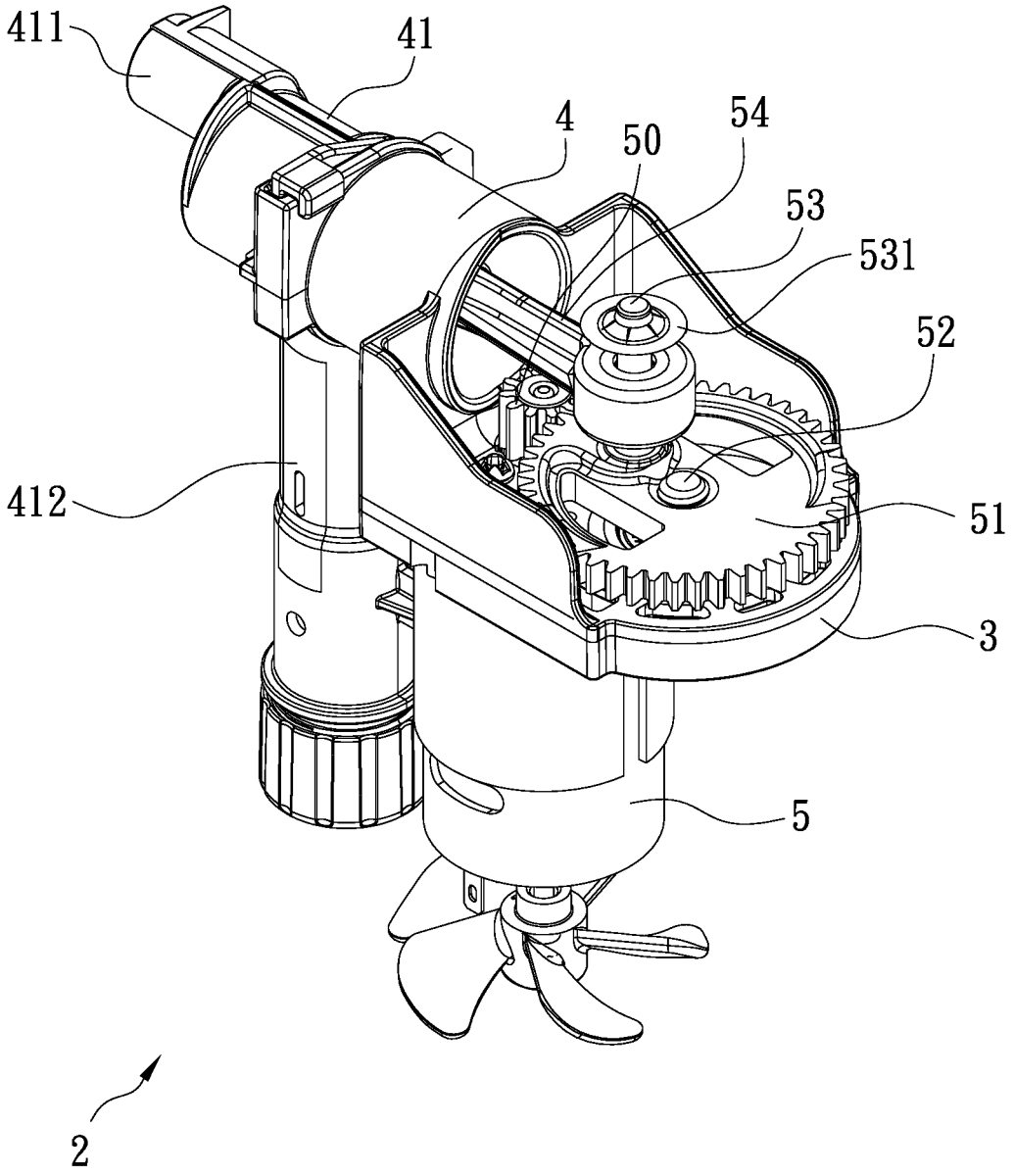
FIG. 1 is a perspective view showing the assembly of an air compressor according to a preferred embodiment of the present invention.
Figure 2:
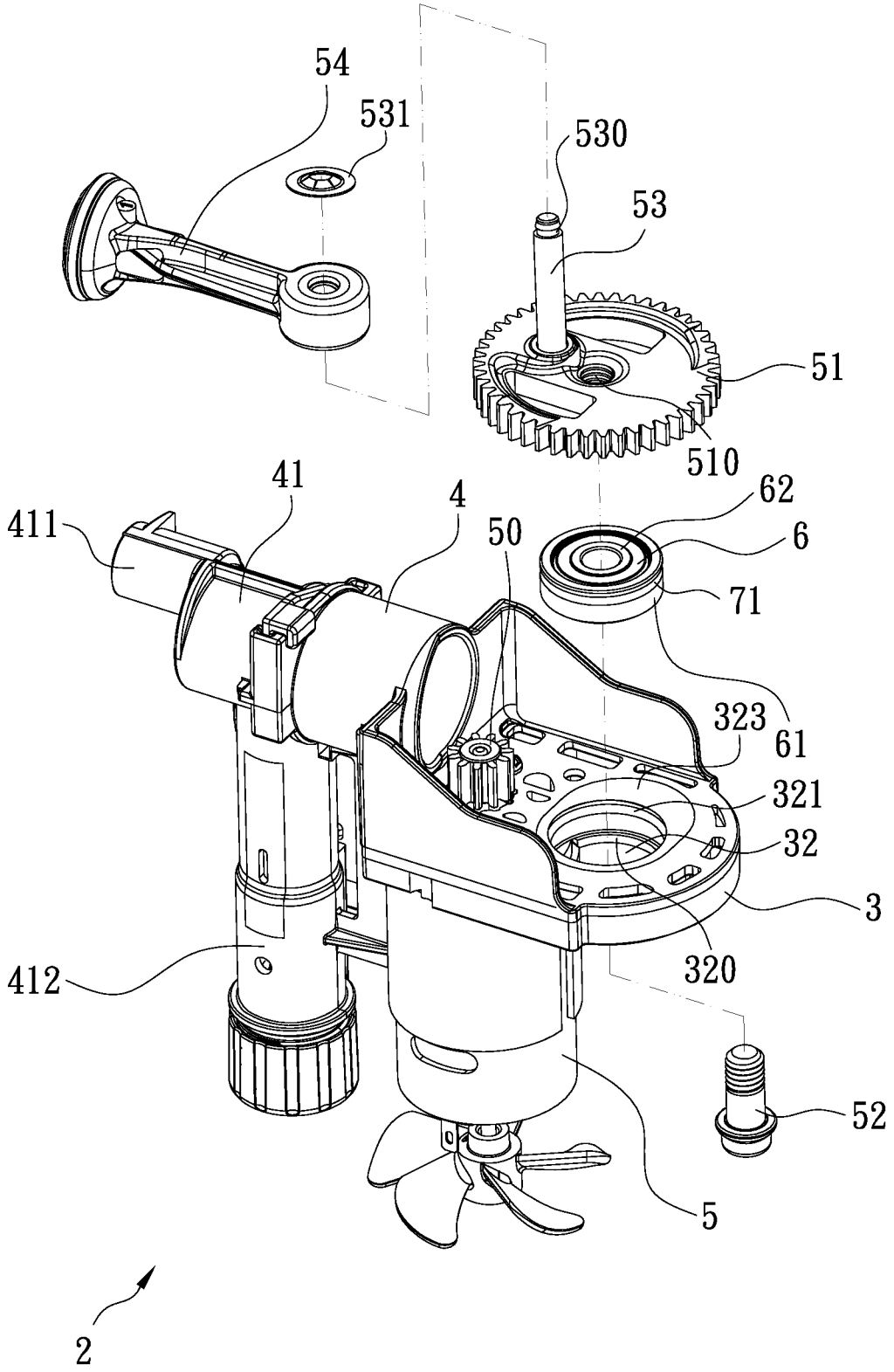
FIG. 2 is a perspective view showing the exploded components of the air compressor according to the preferred embodiment of the present invention.
Figure 3:
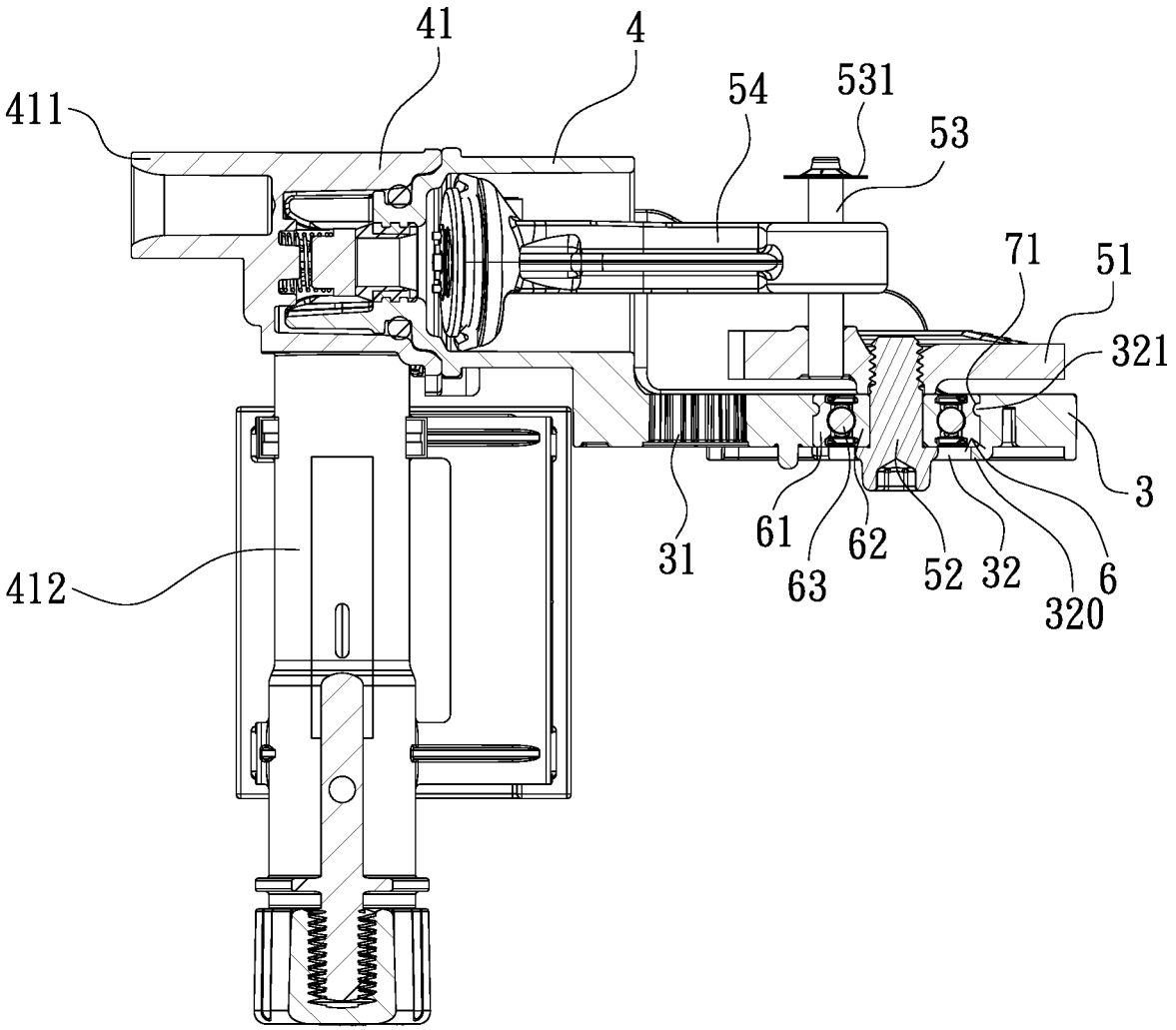
FIG. 3 is a cross sectional view showing the assembly of the air compressor according to the preferred embodiment of the present invention.

With reference to FIGS. 1-3, a structure of fixing a bearing 6 of an air compressor 2 according to a preferred embodiment of the present invention, the air compressor 2 comprises: a base 3, a cylinder 4 connected on the base 3, a motor 5 and a transmission mechanism 51 which are connected with the base 3.

Figure 5:
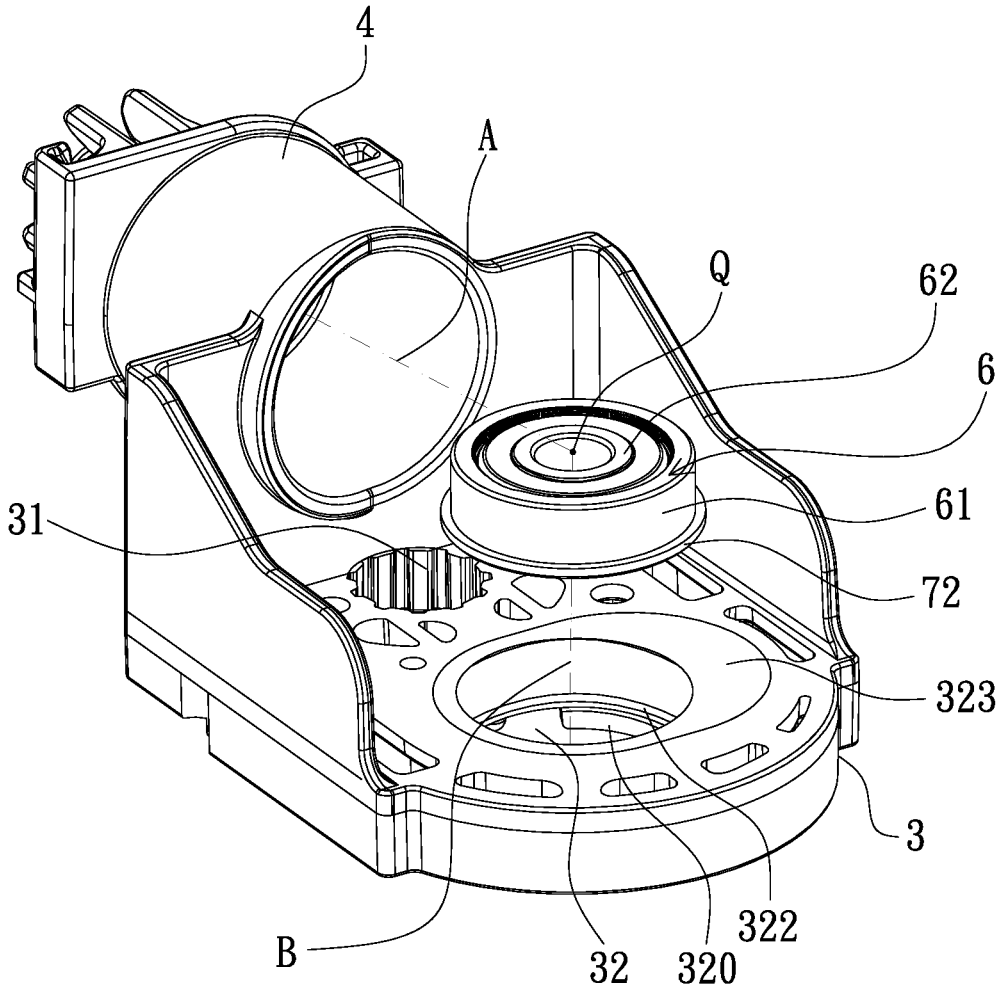
FIG. 5 is a cross-sectional perspective view showing the exploded components of a part of the structure of fixing the bearing of the air compressor according to the preferred embodiment of the present invention.

The base 3 includes multiple positioning orifices (i.e., a first positioning orifice 31 and a second positioning orifice 32), wherein the first positioning orifice 31 accommodates a pinion 50 on a core end of the motor 5, the second positioning orifice 32 accommodates the bearing 6, wherein the bearing 6 includes a first ring 61, a second ring 62, and multiple balls 63 defined between the first ring 61 and the second ring 62, wherein the second positioning orifice 32 includes a shoulder 320 formed on a bottom thereof to avoid a removal of the bearing 6 from the second positioning orifice 32, and the second positioning orifice 32 includes a non-circular surrounding face 323 formed around a top thereof so that the bearing 6 is replaced onto the base 3, a central axis A of the cylinder 4 is perpendicular to a longitudinal axis B extending from a center of the second positioning orifice 32 so as to produce an intersection point Q, as shown in FIG. 5. In the meantime, a piston 54 of the cylinder 4 operates normally instead of eccentrically. The non-circular surrounding face 323 facilitates a removal of the bearing 6 from the central axis of the cylinder 4 so that the central axis A is not perpendicular to and is intersected with the longitudinal axis B so that the piston 54 of the cylinder 4 operates eccentrically, thus not producing the intersection point Q.

The cylinder 4 is integrally connected on the base 3, and the cylinder 4 includes an air storage chamber 41 communicating therewith, wherein the air storage chamber 41 has an air outflow pipe 411 configured to output air, and the air storage chamber 41 has a pressure gauge 412.

The transmission mechanism 51 actuates the piston 54 to move in the cylinder 4 reciprocatingly so as to produce compressed air, wherein the transmission mechanism 51 is a gear integrally formed in a powder metallurgy manner and meshing with the pinion 50, wherein the transmission mechanism 51 includes a threaded hole 510 defined on a center thereof and a connection post 53 beside the threaded hole 510, wherein the connection post 53 has a notch 530 defined around a distal end thereof away from the threaded hole 510.

Figure 4:
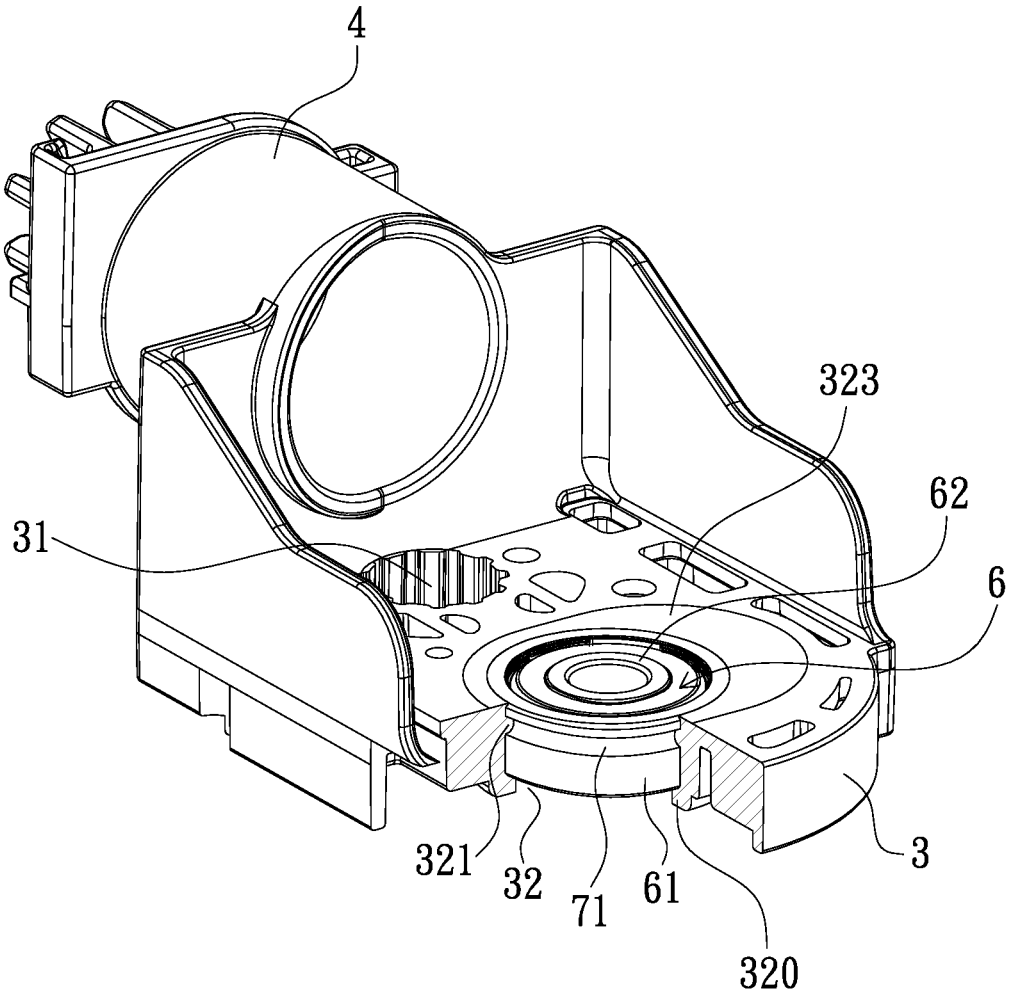
FIG. 4 is a cross-sectional perspective view showing the assembly of a part of a structure of fixing a bearing of an air compressor according to the preferred embodiment of the present invention.

Referring to FIGS. 2-4, the piston 54 is rotatably connected with the connection post 53 of the transmission mechanism 51, a locking disc 531 is retained with the notch 530 of the connection post 53 to avoid a removal of the piston 54 when the transmission mechanism 51 operates. The piston 54 is accommodated into the cylinder 4, the threaded hole 510 of the transmission mechanism 51 corresponds to the second ring 62 of the bearing 6 in the second positioning orifice 32 of the base 3, and a screw bolt 52 is inserted through the second ring 62 of the bearing 6 from the base 3 to screw with the threaded hole 510.

As shown in FIGS. 2-12, the first ring 61 of the bearing 6 is non-circular, and a shape of the second positioning orifice 32 of the base 3 corresponds to the first ring 61 so as to avoid an idle rotation of the bearing 6 in the second positioning orifice 32 of the base 3 or a removal of the bearing 6 from the second positioning orifice 32.

As illustrated in FIGS. 2-4, the first ring 61 of the bearing 6 has a peripheral recess 71 retained with a rib 321 of the second positioning orifice 32, such that the first ring 61 of the bearing 6 is locked, the bearing 6 does not remove when the transmission mechanism 51 operates, and the piston 54 operates in the cylinder 4 smoothly, thus prolonging a service life of the air compressor 2.

With reference to FIG. 5, in another embodiment, the ring 61 of the bearing 6 has a protrusion 72 retained with a trench 322 of the second positioning orifice 32 of the base 3, such that the first ring 61 of the bearing 6 is locked, the bearing 6 does not remove when the transmission mechanism 51 operates, and the piston 54 operates in the cylinder 4 smoothly, thus prolonging the service life of the air compressor 2.

Figure 6:
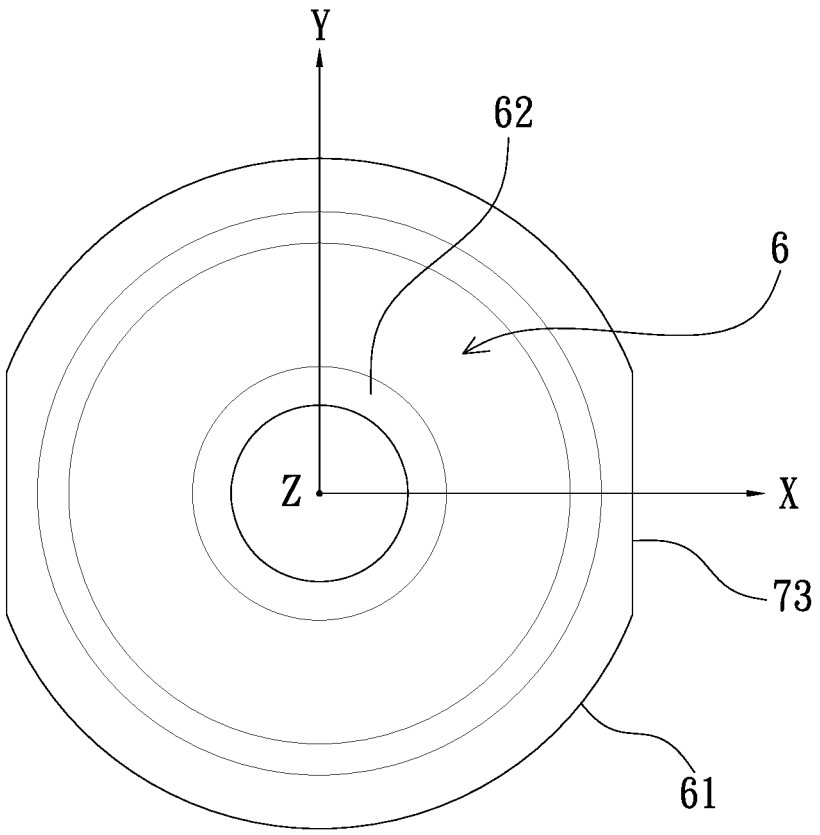
FIG. 6 is a side plan view showing the assembly of a part of a structure of fixing a bearing of an air compressor according to another preferred embodiment of the present invention.

Referring to FIG. 6, in another embodiment, the first ring 61 of the bearing 6 has at least one tangent plane 73 formed on an X axis of a three-dimensional space.

Figure 7:
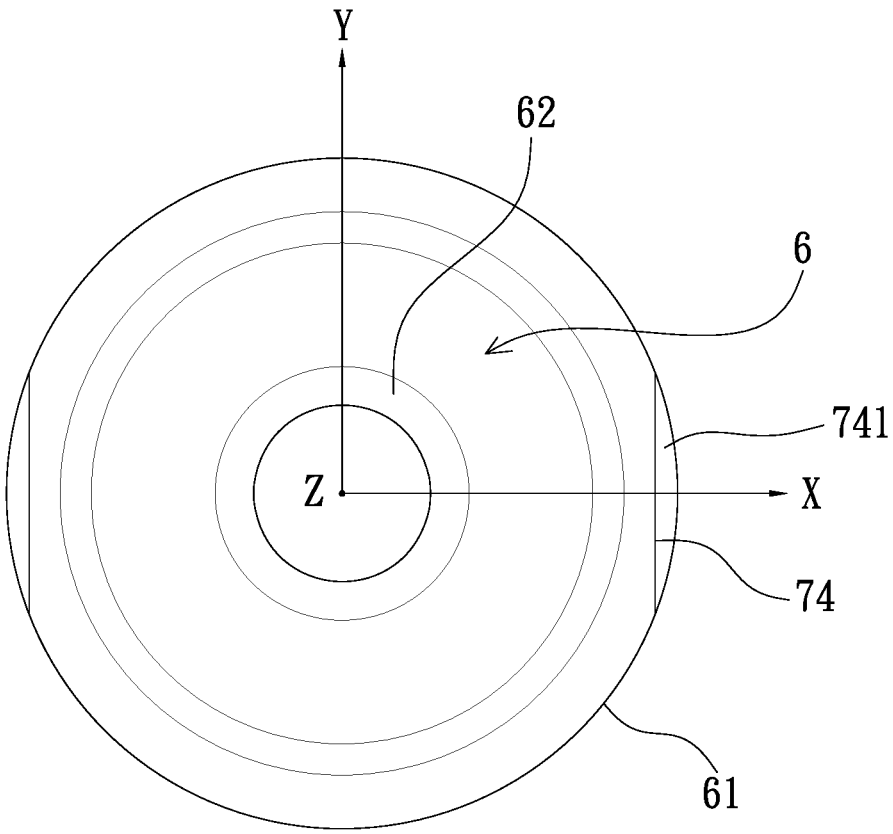
FIG. 7 is a side plan view showing the assembly of a part of a structure of fixing a bearing of an air compressor according to another preferred embodiment of the present invention.

As shown in FIG. 7, in another embodiment, the first ring 61 of the bearing 6 has a partial tangent plane 74 formed on an X axis of a three-dimensional space, i.e., the first ring 61 of the bearing 6 has at least one platform 741 formed on the X axis so that the bearing 6 does not rotate idly in or does not remove from the second positioning orifice 3, when the transmission mechanism 51 operates.

Figure 8:
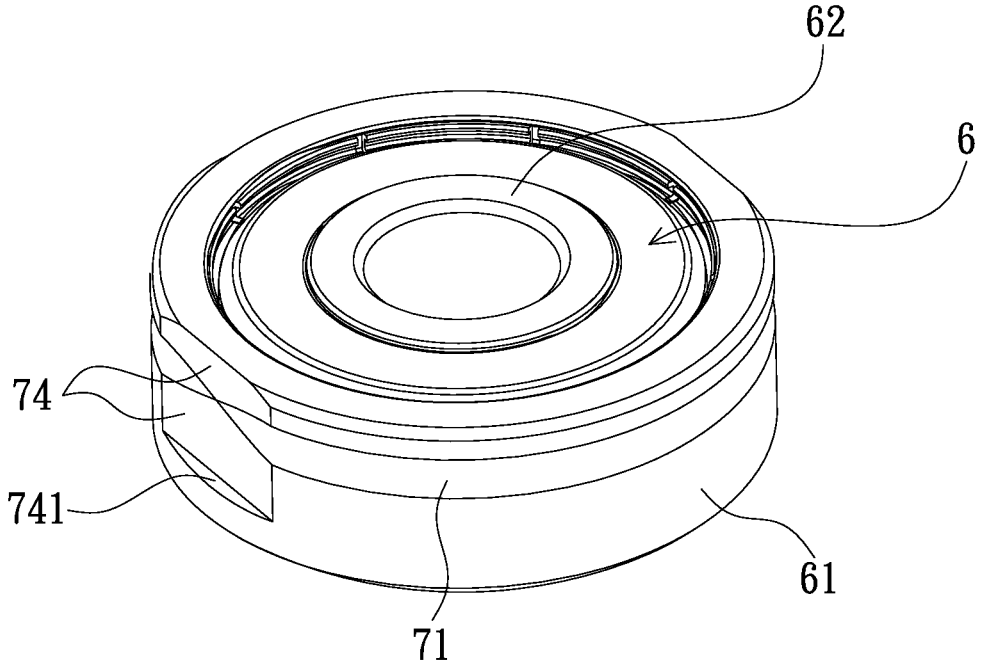
FIG. 8 is a perspective view showing the assembly of a part of a structure of fixing a bearing of an air compressor according to another preferred embodiment of the present invention.
Figure 9:
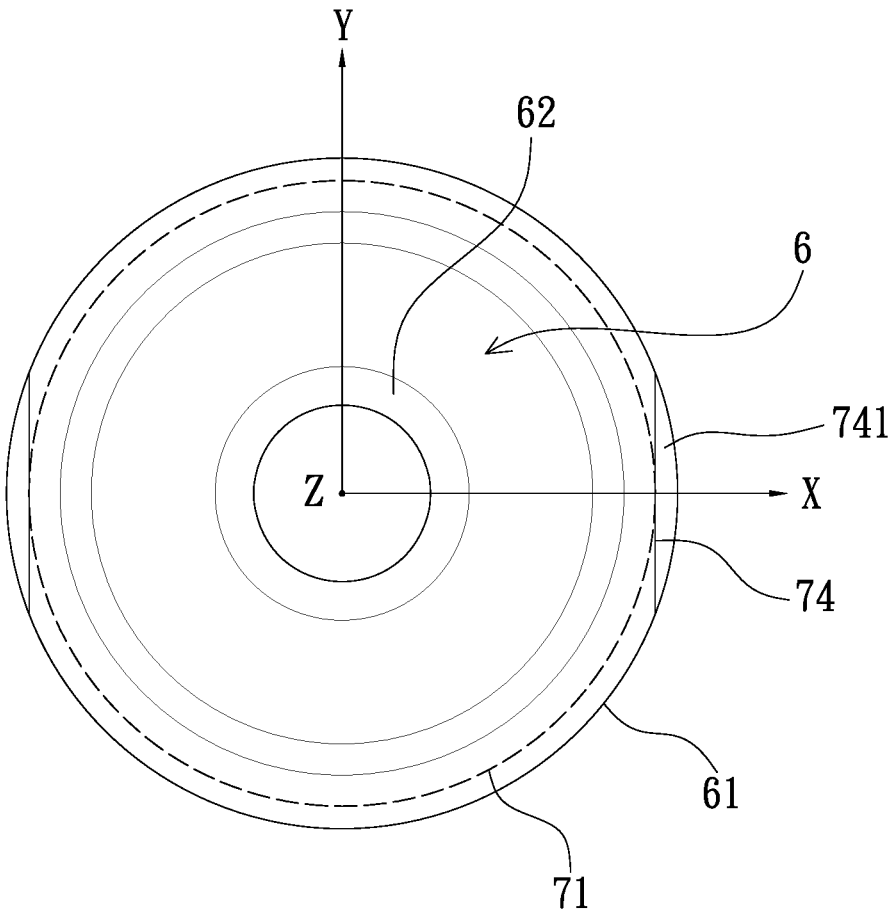
FIG. 9 is a side plan view of FIG. 8.

As shown in FIGS. 8-9, in another embodiment, the first ring 61 of the bearing 6 has the peripheral recess 71 retained with the rib 321, the partial tangent plane 74 and the at least one platform 741 which are formed on the X axis of a three-dimensional space.

Figure 10:
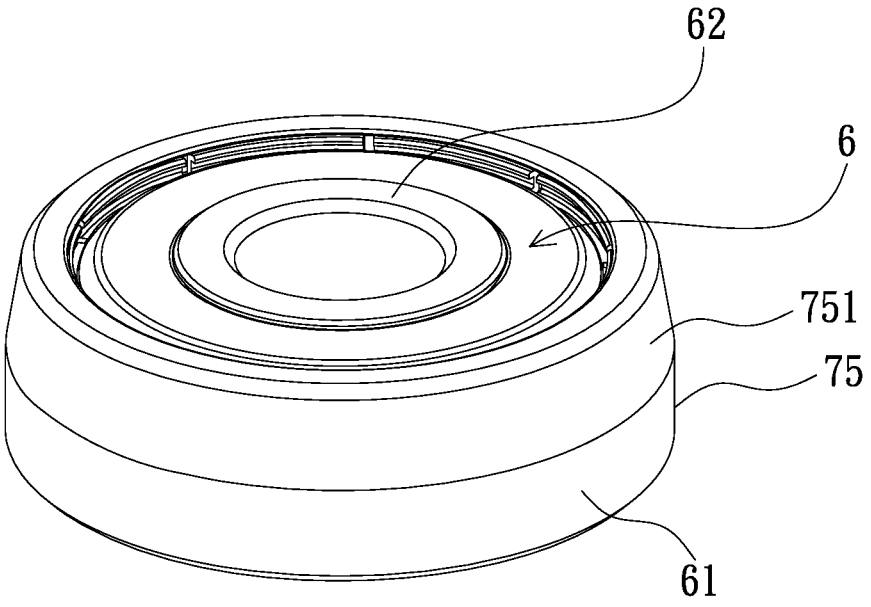
FIG. 10 is a perspective view showing the assembly of a part of a structure of fixing a bearing of an air compressor according to another preferred embodiment of the present invention.

As illustrated in FIG. 10, in another embodiment, the first ring 61 of the bearing 6 has a peripheral face 75 and a beveled face 751 extending from the peripheral face 75, wherein a diameter of the beveled face 751 is less than the peripheral face 75 so that the bearing 6 does not remove from the second positioning orifice 32 of the base 3, when the transmission mechanism 51 operates.

Figure 11:
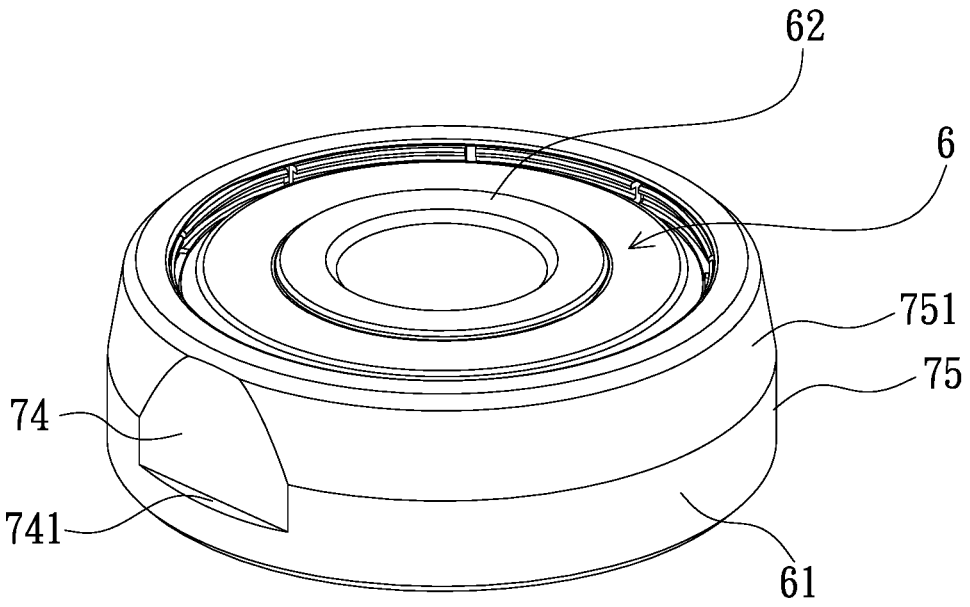
FIG. 11 is a perspective view showing the assembly of a part of a structure of fixing a bearing of an air compressor according to another preferred embodiment of the present invention.
Figure 12:
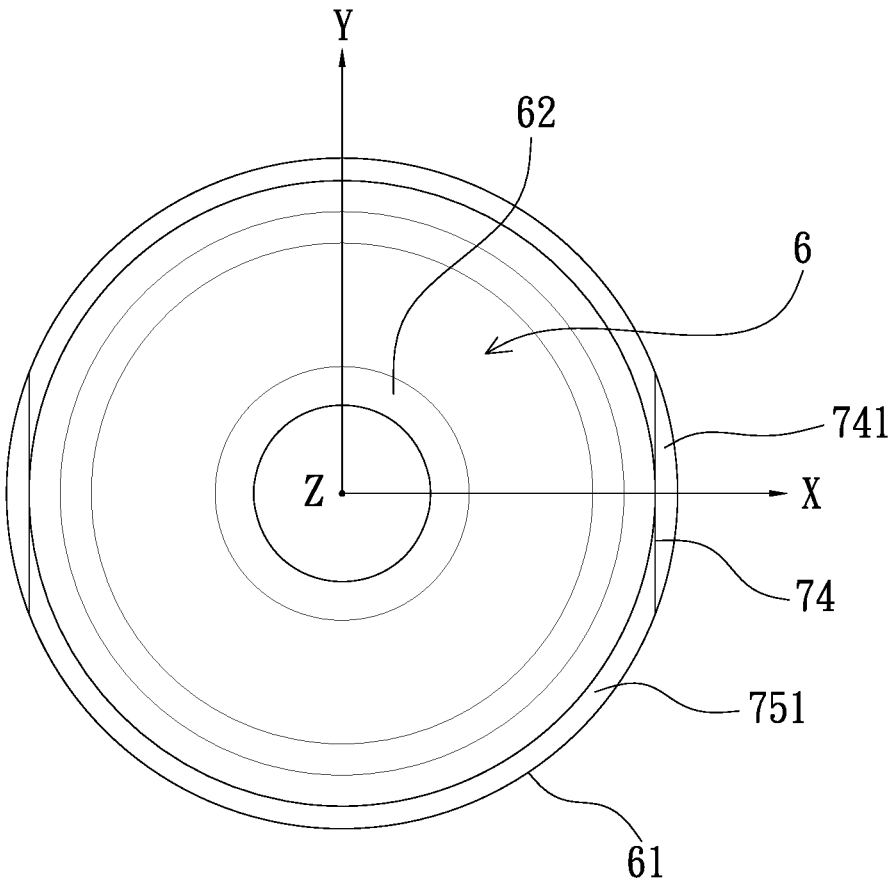
FIG. 12 is a side plan view of FIG. 11.

With reference to FIGS. 11-12, in another embodiment, the first ring 61 of the bearing 6 has the peripheral face 75, the beveled face 751, the partial tangent plane 74 and the at least one platform 741 which are formed on the X axis of the three-dimensional space.

Figure 13:
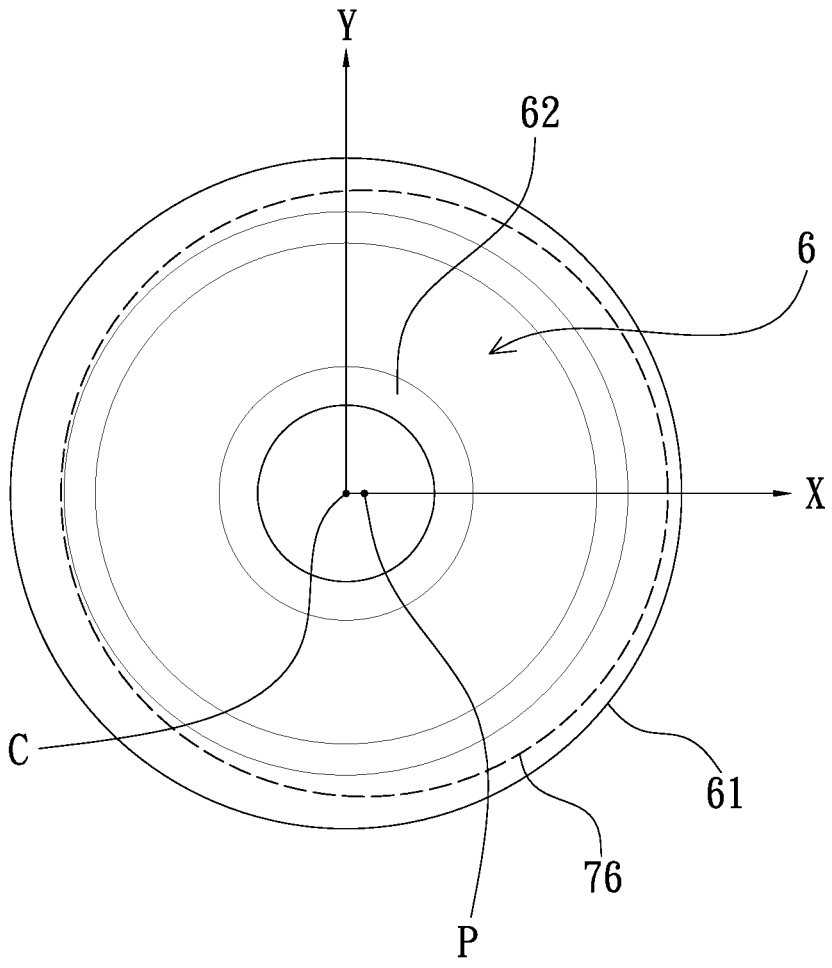
FIG. 13 is a side plan view showing the assembly of a part of a structure of fixing a bearing of an air compressor according to another preferred embodiment of the present invention.
Figure 14:
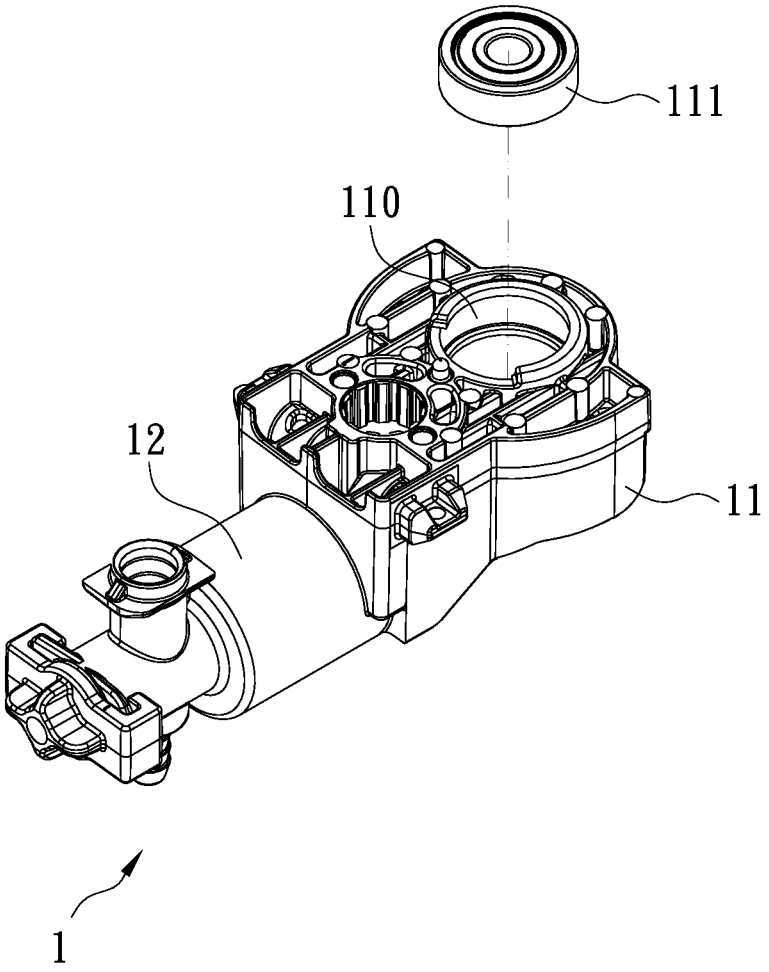
FIG. 14 is a perspective view showing the exploded components of a conventional air compressor.

Referring to FIG. 13, the first ring 61 of the bearing 6 has a groove 76, a central axis P of which is not identical to a central axis C of the bearing 6, i.e., the first ring 61 is not concentric with the bearing 6.

Accordingly, the screw bolt 53 of the transmission mechanism 51 is rotatably with the bearing 6, the first ring 61 of bearing 6 is non-circular, and the shape of the second positioning orifice 32 of the base 3 corresponds to the first ring 61 so as to avoid an idle rotation of the bearing 6 in the second positioning orifice 32 of the base 3 or a removal of the bearing 6 from the second positioning orifice 32. Preferably, the piston 54 operates in the cylinder 4 smoothly, thus prolonging the service life of the air compressor 2.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention

What is claimed is:

1. A structure for fixing a bearing of an air compressor, the air compressor comprising:

a base including a first positioning orifice and a second positioning orifice;

a cylinder connected to the base and including an air storage chamber communicating with the cylinder;

a transmission mechanism actuating a piston to move in the cylinder reciprocatingly so as to produce compressed air;

wherein the structure for fixing the bearing comprises:

a bearing disposed in the second positioning orifice, the bearing comprising a first ring that is non-circular, and a shape of the second positioning orifice corresponds to the first ring to prevent rotation of the first ring of the bearing with respect to the second positioning orifice;

the first positioning orifice accommodates a pinion coupled to a motor;

the bearing further includes a second ring, and multiple balls are disposed between the first ring and the second ring; and the second positioning orifice includes a shoulder formed on a bottom thereof to prevent removal of the bearing from the second positioning orifice, and the second positioning orifice includes a non-circular surrounding face formed around a top thereof.

2. The structure as claimed in claim 1, wherein the transmission mechanism includes a threaded hole defined in a center thereof and a connection post adjacent the threaded hole, the threaded hole of the transmission mechanism corresponding to the second ring of the bearing in the second positioning orifice of the base, a screw inserted through the second ring of the bearing from the base to threadedly engage with the threaded hole, and the piston is connected to the connection post of the transmission mechanism.

3. The structure as claimed in claim 2, wherein the transmission mechanism is a gear integrally formed in a powder metallurgy manner and meshing with the pinion.

4. The structure as claimed in claim 1, wherein the first ring of the bearing has a peripheral recess retained with a rib disposed in the second positioning orifice, such that the first ring of the bearing is locked, and the first ring of the bearing does not move when the transmission mechanism operates.

5. The structure as claimed in claim 1, wherein the first ring of the bearing has a protrusion retained in a trench disposed in the second positioning orifice of the base, such that the first ring of the bearing is locked, and the first ring of the bearing does not move when the transmission mechanism operates.

6. The structure as claimed in claim 1, wherein the first ring of the bearing has defined on an outer surface thereof at least one tangent plane.

7. The structure as claimed in claim 4, wherein the first ring of the bearing has defined on an outer surface thereof a partial tangent plane, wherein the partial tangent plane defining at least one platform so that the first ring of the bearing does not rotate in, or does not remove from, the second positioning orifice, when the transmission mechanism operates.

8. The structure as claimed in claim 7, wherein the first ring of the bearing has a peripheral face and a beveled face extending from the peripheral face, wherein a diameter of the beveled face is less than a diameter of the peripheral face so that the bearing does not remove from the second positioning orifice of the base, when the transmission mechanism operates.

9. The structure as claimed in claim 8, wherein the first ring of the bearing has the peripheral face, the beveled face, the partial tangent plane and the at least one platform.

10. The structure as claimed in claim 4, wherein the first ring of the bearing has a groove, a central axis of which is not identical to a central axis of the bearing, and the first ring is not concentric with the bearing.

11. The structure as claimed in claim 1, wherein the piston is connected to a connection post of the transmission mechanism, and a locking disc is retained with a notch of the connection post to prevent removal of the piston when the transmission mechanism operates.

* * * * *